US006484770B1

(12) United States Patent
Jonkka

(10) Patent No.: US 6,484,770 B1
(45) Date of Patent: Nov. 26, 2002

(54) METHOD OF CHIPPING OF WOOD AND A DISC CHIPPER

(75) Inventor: Arvo Jonkka, Pori (FI)

(73) Assignee: Metso Woodhandling Oy, Pori (FI)

( * ) Notice: Subject to any disclaimer, the term of this patent is extended or adjusted under 35 U.S.C. 154(b) by 0 days.

(21) Appl. No.: 09/673,622

(22) PCT Filed: May 5, 1999

(86) PCT No.: PCT/FI99/00376

§ 371 (c)(1),
(2), (4) Date: Dec. 28, 2000

(87) PCT Pub. No.: WO99/58310

PCT Pub. Date: Nov. 18, 1999

(30) Foreign Application Priority Data

May 8, 1998 (FI) ..... 981033

(51) Int. Cl.[7] ..... B27L 11/00

(52) U.S. Cl. ..... 144/373; 144/176; 241/92; 241/278.1

(58) Field of Search ..... 144/162.1, 176, 144/363, 369, 373; 241/28, 55, 56, 92, 278.1

(56) References Cited

U.S. PATENT DOCUMENTS

| | | | | |
|---|---|---|---|---|
| 3,661,329 A | | 5/1972 | Smith et al. | 241/28 |
| 3,682,400 A | | 8/1972 | Smith | 241/56 |
| 3,905,558 A | | 9/1975 | Gaitten | 241/55 |
| 4,685,497 A | * | 8/1987 | Mierau et al. | 144/176 |
| 5,373,876 A | | 12/1994 | Tähkänen et al. | 144/176 |
| 5,975,169 A | * | 11/1999 | Jonkka et al. | 144/176 |

FOREIGN PATENT DOCUMENTS

| | | |
|---|---|---|
| EP | 0 911 127 A2 | 4/1999 |

* cited by examiner

*Primary Examiner*—W. Donald Bray
(74) *Attorney, Agent, or Firm*—Burns, Doane, Swecker & Mathis, LLP

(57) ABSTRACT

A wood chipping method and a disc chipper provided with knives (4). The chips (11), after having separated from a log (3), pass through a chip opening (12) in the disc (1) and hit an impact surface (10) located after a knife. Along different portions of the knife (4), a stronger impact effect is caused in proximity to the centre than in proximity to the outer periphery of the disc. The direction of the impact surface (10) deviates more from the direction of the rear surface (15) of the knife in proximity to the centre of the disc than in proximity to the outer periphery of the disc. The distance of the connecting line between the rear surface (15) of the knife and the impact surface (10) from the cutting edge (16) of the knife can be longer on the outer periphery of the disc than in the centre of the disc.

6 Claims, 7 Drawing Sheets

METHOD OF CHIPPING OF WOOD AND A DISC CHIPPER

Wood chips used in the paper and pulp industry are presently produced mainly by means of disc chippers developed for chipping of large amounts of wood. One disc chipper known in the art is described in published application FI 91946. Chipping results show that disc chippers can produce chips of very high quality. With a good chipper the share of the accepted fraction should be about 90%. According to tests a result like this is easy to obtain in test chipping by using a suitable chip length and chipping speed. Even production chippers of big size and with a uniform wood quality and capacity can obtain these values.

However, under normal manufacturing conditions the different factors which the chip quality depends on, like the diameter of the logs, the amount of wood to be chipped and the dry solids content of the wood, vary constantly. The main problems related to chipping by ski means of a disc chipper are in that the amount of sawdust and pin fractions (fine fractions) increases when the amount of oversize and overthick chips (coarse fraction) is reduced. (In the chip size distribution analysing method SCAN-CM 40:94 the chips are distributed into oversize, overthick, accepted, pin and sawdust fractions).

The chippers known in the prior art perform the chipping mostly in the centre of the chipper knives, and the object has been to provide the best chipping conditions in the centre of the knives in order to maximize the quality of the chips. However, the "scissors force" and/or the cutting force the knives moves/move the logs closer to the centre of the disc if the logs are small or dry. Even when the capacity is used to the maximum, the chipping occurs partly in proximity to the centre of the disc and partly in proximity to the outer periphery. In view of the fact that the cutting process is less violent in proximity to the centre, a great deal of coarse fraction is produce in that area. On the outer periphery, instead, a large amount of fine fraction is produced due to the increase in the cutting speed. The cutting force in chipping in a vertical feed chipper and other factors relating to such chippers are described in patent application FI 973078.

The method and the disc chipper according to the invention make it possible to level down these kinds of differences in quality resulting from the chipping in different portions of the disc of the chipper and thus from the chipping at different cutting speeds. The characterising features of the invention are set forth in claims 1 and 4.

The method of producing chips of uniform quality levels out short-term differences in quality resulting from the constantly varying capacity, from the varying diameters of the logs or from the varying dry solids content of the logs. The method produces chips of more uniform quality despite the above-mentioned differences.

Figure 1:
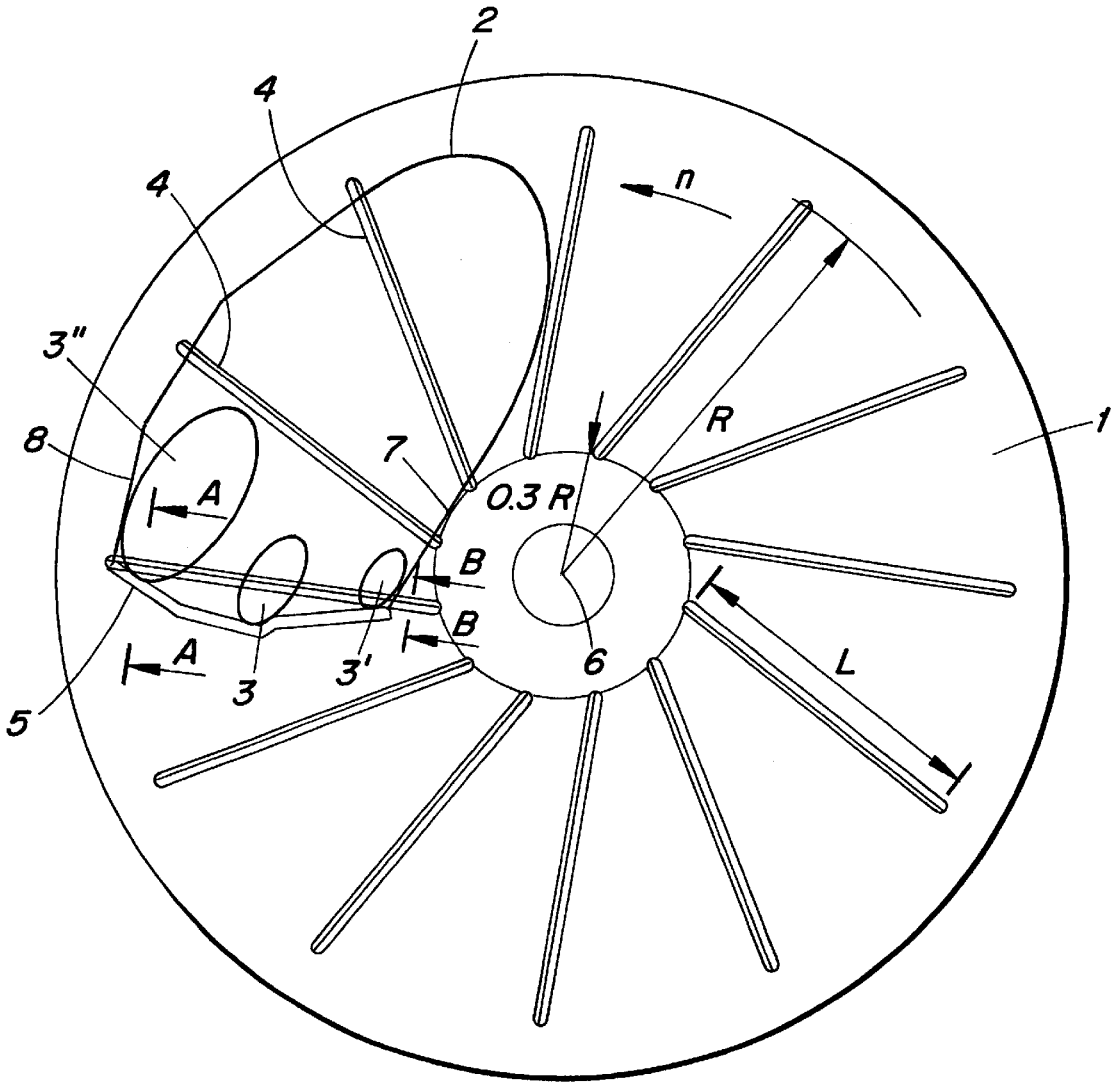
Figure 2:
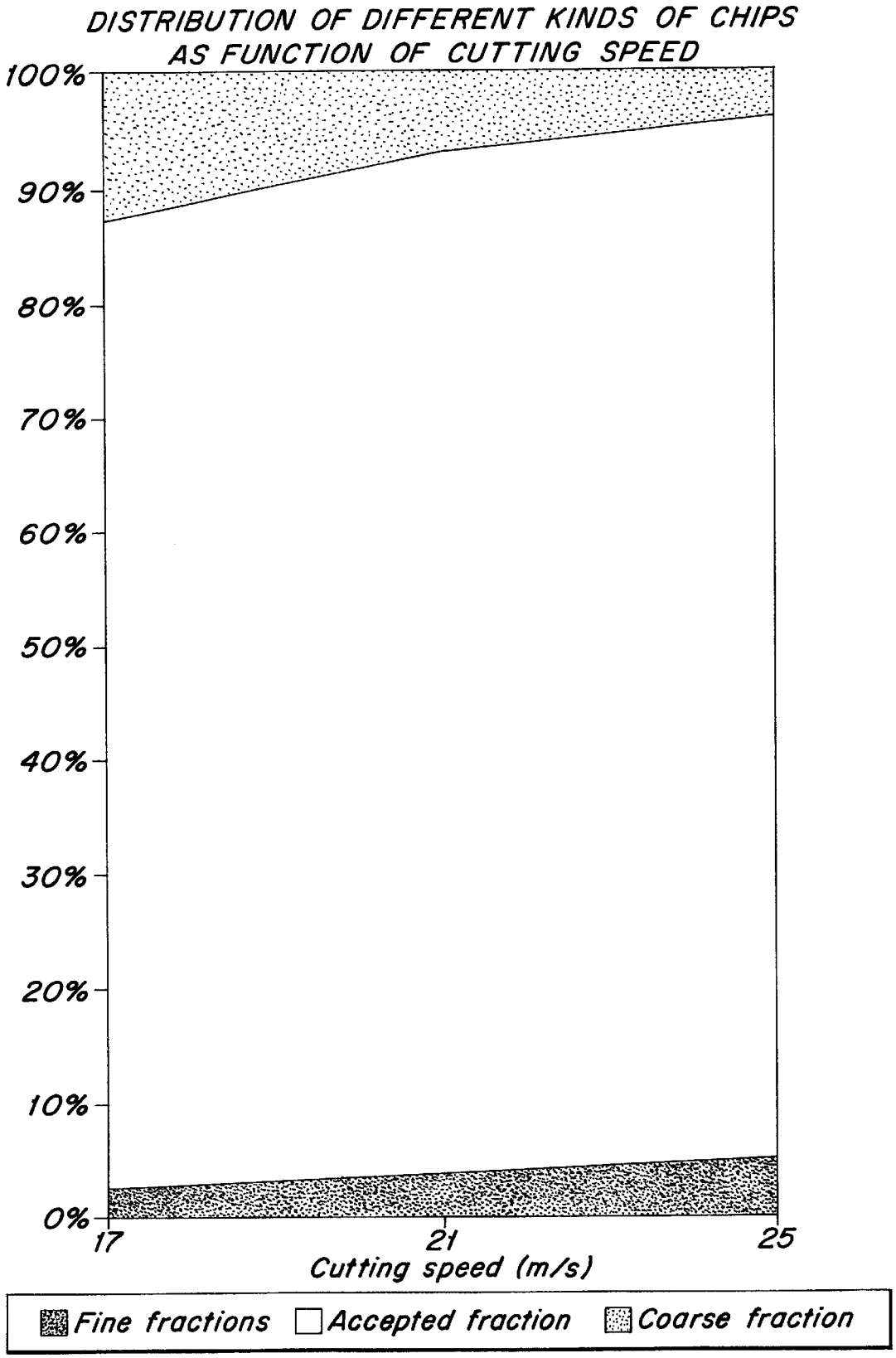
Figure 3:
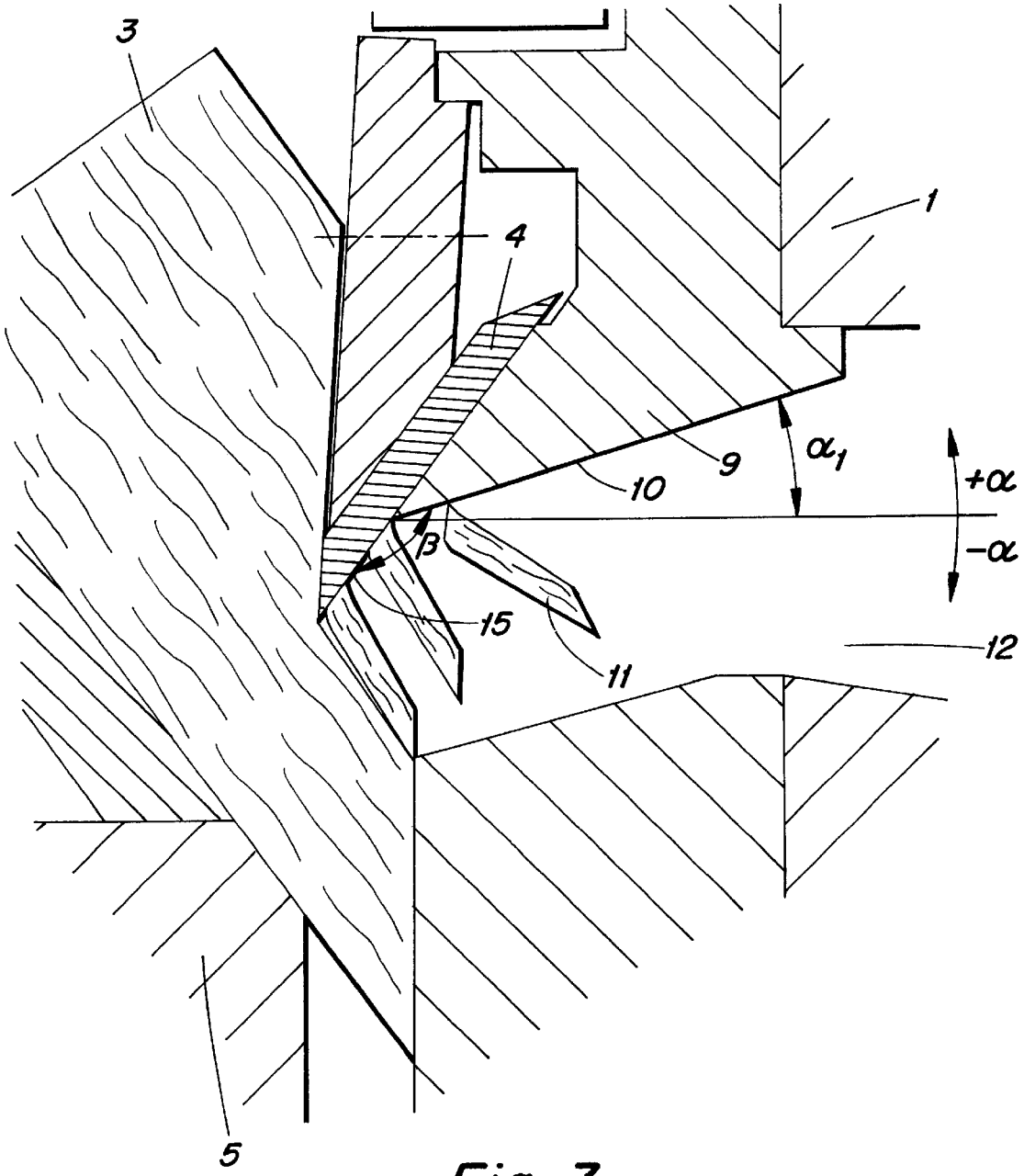
Figure 4:
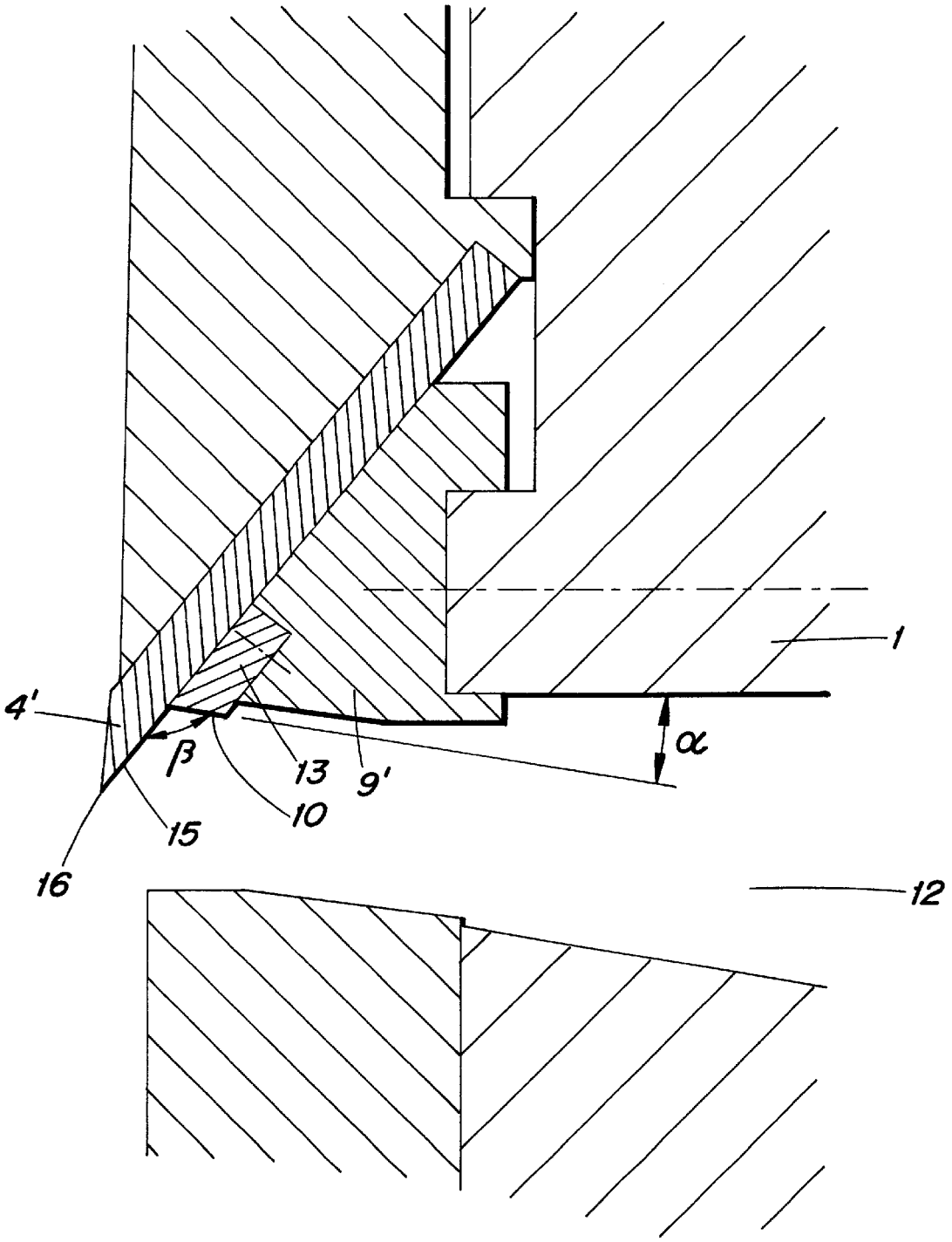
Figure 5:
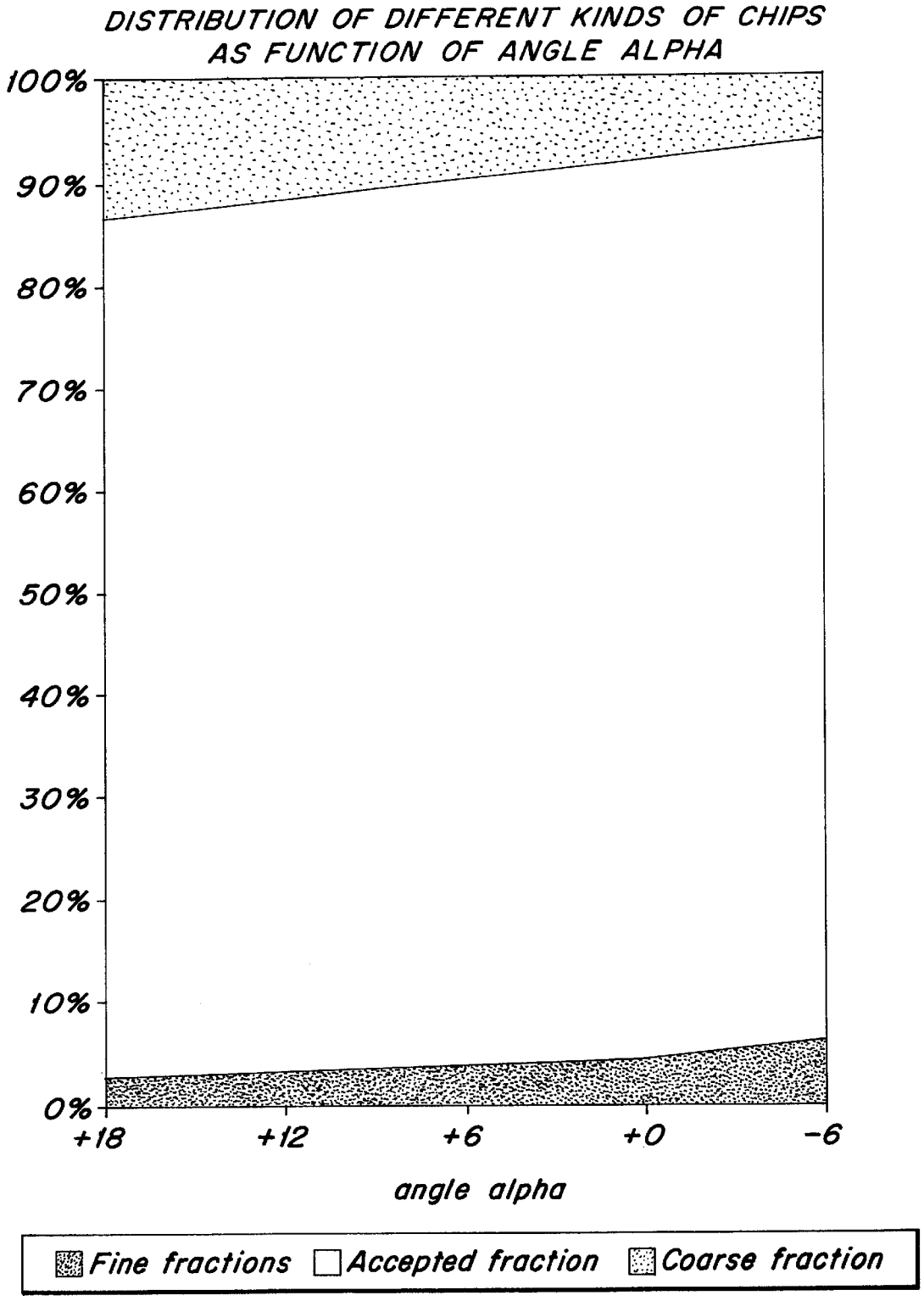
Figure 6:
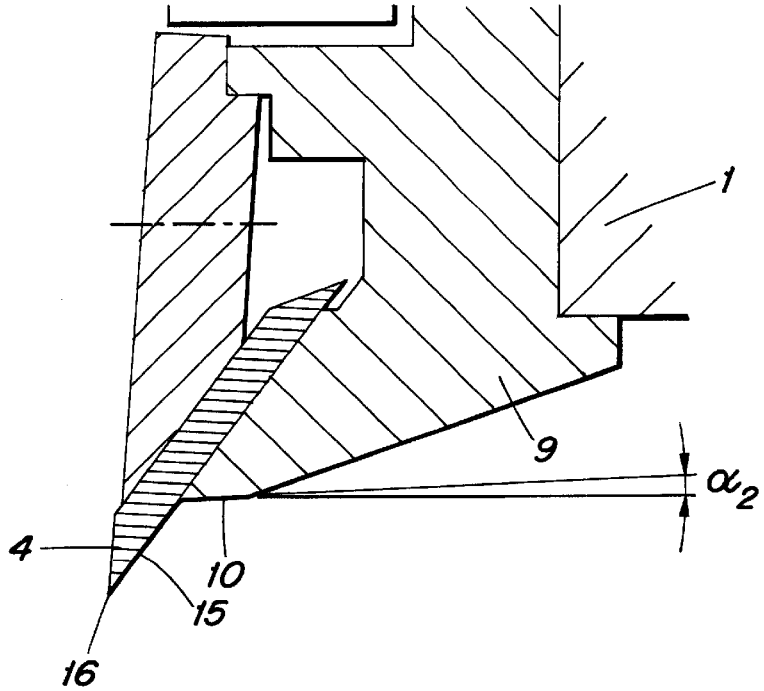
Figure 8:
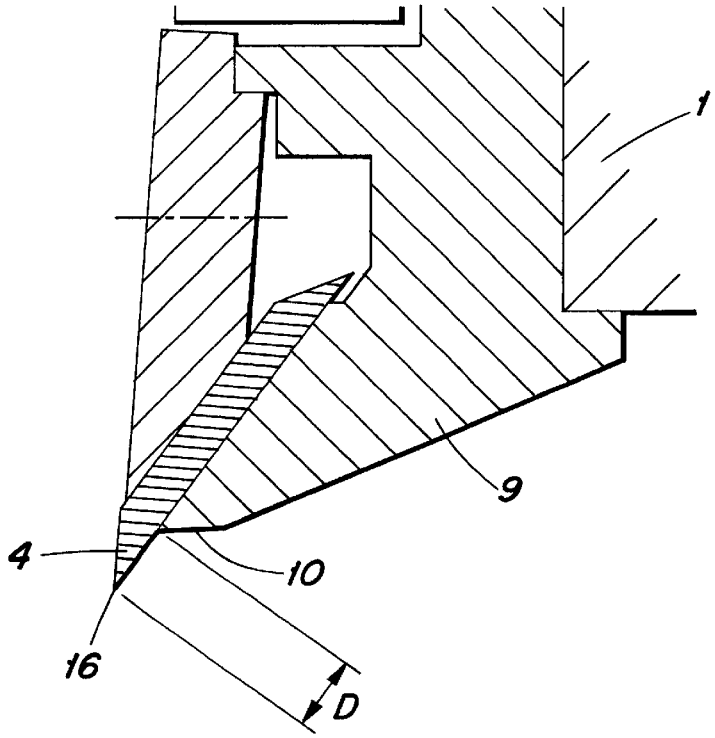
Figure 7:
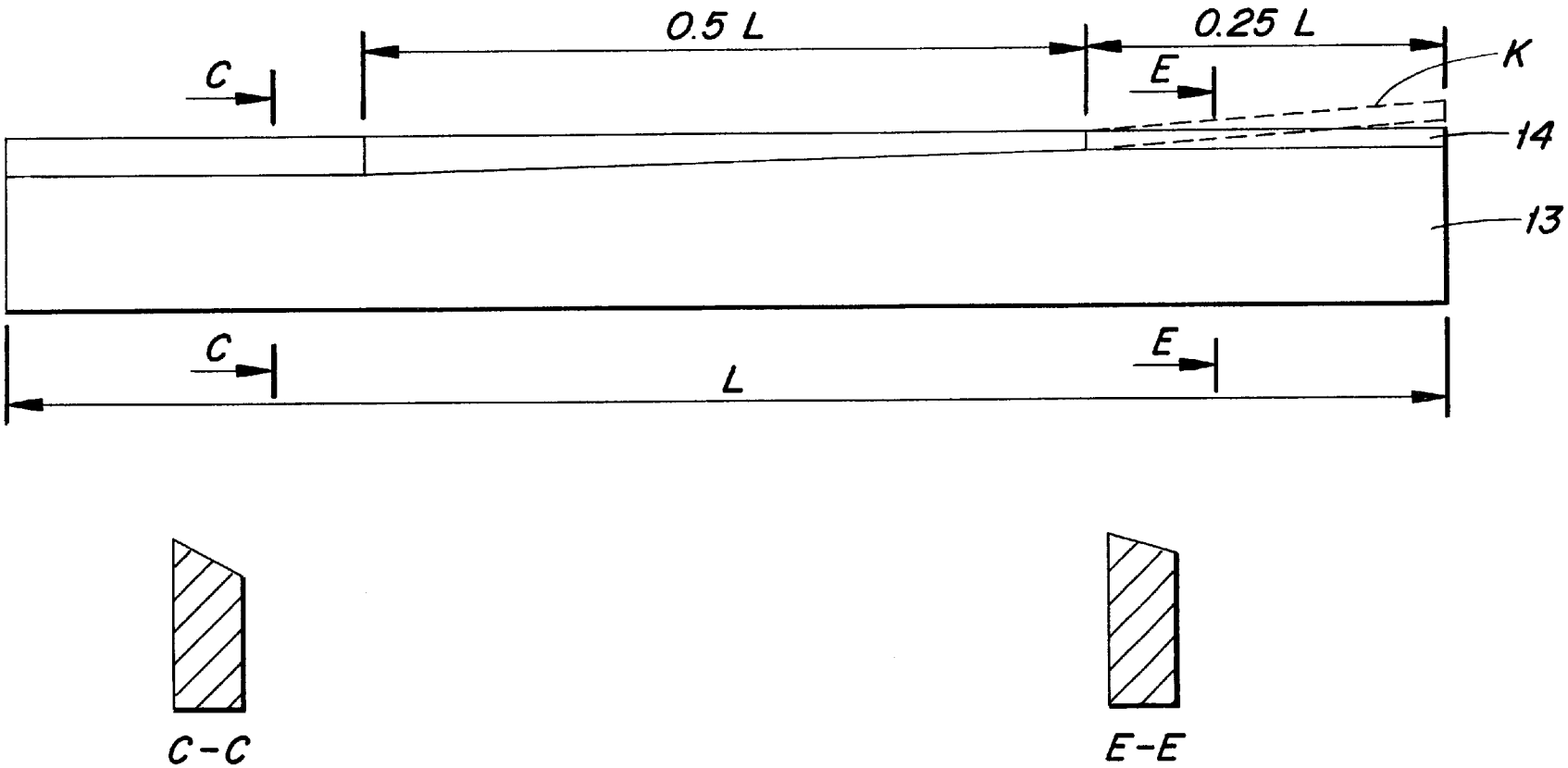

The invention and the details thereof will now be described in more detail with reference to the accompanying drawings in which FIG. 1 shows the disc of a disc chipper and its cutting geometry viewed from the wood feeding side, FIG. 2 shows the quality of chips as a function of cutting speed, FIG. 3 is a view of section A—A of FIG. 1, during chipping, FIG. 4 is a view of section A—A of FIG. 1, in a chipper having a traditional knife equipment, FIG. 5 shows the quality of chips with different angles a of the front edge of the knife base, FIG. 6 is a view of section B—B of the disc of the chipper shown in FIG. 1, FIG. 7 is a view of a knife strip according to the invention and of sections C—C and E—E thereof, and FIG. 8 shows a further method of compensating the cutting speed in the knife base.

FIG. 1 shows the knife disc 1 of a disc chipper viewed from the wood feeding side. The figure shows also the opening 2 of the feeding chute of a vertical feed chipper which is fed by means of a feeding chute. The opening ends at the knife disc 1. The logs to be chipped form a cutting ellipse 3 against the knife disc 1. The knife disc 1 rotates at a given speed n. When the knives 4 perform chipping, the logs in the chute place themselves against the counter knife 5 at different distances from the centre of rotation 6 of the disc, depending on the number of the logs to be chipped, on the diameters and the dry solids content of the logs.

The cutting force in the direction of the cutting edge of the knife, and partly the "scissors force", of the knives move small logs 3' towards the inner periphery 7 of the opening. When it comes to small logs, the cutting force dominates compared with the "scissors force". When it comes to bigger logs 3", instead, the "scissors force" dominates and moves the logs having a large diameter towards the outer periphery 8 of the feeding opening. The cutting force moves dry wood more effectively because the friction coefficient between the knives and the wood is higher. When the capacity is at its maximum, the logs place themselves over the whole length of the counter knife, and so they are cut into pieces at different positions. For the aforementioned reasons various logs are chipped at different cutting speeds.

The higher the cutting speed, the more "violent" is the cutting process. It will be understood by those skilled in art that a greater cutting speed results in a decrease in the share of oversize and overthick fractions, i.e. in the share of coarse fractions, and in an increase in the share of sawdust and pin fractions, i.e. in the share of fine fractions.

FIG. 2 illustrates the result of a test about the effect of the cutting speed on the distribution of the different kinds of chips. The x-axis and y-axis stand for the cutting speed and for the distribution of the different kinds of chips, respectively. The lowermost area and the uppermost area stand for the share of fine fractions and for the share of coarse fractions, respectively. The area between the lowermost and the uppermost areas stands for the share of the accepted fraction. According to the test, the amount of coarse fractions decreases from the level of about 13% to the level of 4% with a 50% increase of the chipping speed. At the same time, it can be seen that the increase in the fine fractions is quite reasonable. When it comes to high-production disc chippers and to chipping in proximity to the shaft and towards the outer periphery, 1,5 is a very common chipping speed ratio, i.e. the speed ratio of the different cutting points of the knife. The ratio between the extreme values is even 1 to 3. If it is assumed that the highest chipping speed is 1, the minimum chipping speed is 0,3 and the general chipping speed is 0,5–0,75. Consequently, the chips produced by the chipper are not of uniform quality.

FIG. 3 is a side view of a knife 4 and of the whole knife equipment of a disc chipper. Behind the knife there is a knife base 9 the front surface 10 of which the chips 11 hit after the cutting process. The knife cuts a disc-shaped slab from the log, the slab splitting into chips 11 already at the cutting stage. The chips hit the front face 10 of the knife base and as a result of this they split into smaller pieces and separate from each other. The angle in a vertical plane and between a straight line parallel to the rotational axis of the disc and the surface 10 of the knife base 9 facing the chip opening 12 is here called angle $\alpha$. Correspondingly, the angle between the rear surface 15 of the knife and the surface 10 of the knife base is called angle β. When the angle α, and thus also the angle β, are bigger, the impact effect of the front surface 10 is less and the chipping process is less violent.

FIG. 4 shows the knife equipment of a chipper of an older model. Between a knife 4' and a knife base 9' there is a knife backing 13 which the chips hit after the cutting process. The value of the angle α of the knife backing has often been negative in chippers according to the prior art. The angle α of the knife backing 13 shown in FIG. 4 is about −6° and the chip flow hits the front surface 10 of the knife backing violently.

FIG. 5 illustrates the results of a test about the effect of the angle α on the quality of chips, the cutting speed being constant. In the figure the x-axis and the y-axis stand for the angle α and for the distribution of the different kinds of chips, respectively. The different areas stand for the different kinds of chips in the same way as in FIG. 2. As the angle α becomes smaller and the impact effect increases, the share of coarse fractions decreases considerably, whereas the share of fine fractions increases relatively less, until the zero value of the angle α. When the value of the angle α is negative, the share of fine fractions begins to increase more intensively. It is a well-known fact that the share of fine fractions is big with knife equipment of the same type as the one shown in FIG. 4.

From the foregoing it will be clear that the chipping speed and the angle α of the knife base (knife backing) have a significant effect on the chipping result. Furthermore it is clear that the chippers according to the prior art produce chips of first-rate quality only at a low chipping speed range and along a short portion of the knife.

As it appears from the description above, the variation in the chipping speed can be compensated for in practice by using knife base angles α of 0°–20° if the speed range is 1–1,5. However, as the speed range of a chipper knife is much wider, it is necessary to perform the speed compensation in the knife portion at the inner periphery by placing the counter surface 10 closer to the cutting edge 16 of the knife.

In the method according to the invention, the effect of speed is compensated for by changing the angle α of the knife base from the inner periphery 7 to the outer periphery 8. Where the chipping speed is low, in other words at the inner periphery 7 of the feed opening, the value of the angle α of the knife base (knife backing) is small (FIG. 6, $\alpha_2$) or even negative. Correspondingly, the value of the angle α is great where the chipping speed is high, in others words at the outer periphery 8 of the feed opening (FIG. 3, $\alpha_1$). By changing the value of the angle α according to the distance from the rotating centre of the disc, the "violence"—which is due to differences in the chipping speed—of the chipping process can be maintained constant.

When using long chipper knives, where the angle α cannot compensate for the difference in speed, the counter surface 10 can be brought closer to the cutting edge 16 of the knife without changing the angle $\alpha_2$. Thus, the shorter the distance to the shaft 6 of the chipper, the closer the surface 10 lies to the cutting edge of the knife.

When using a short knife and when the value of the angle α is 0° at the inner periphery, the share of coarse fraction can be made considerably smaller as the impact effect is increased. However, the amount of fine fractions remains reasonable due to the low chipping speed. Due to this, the relative share of accepted fraction in chipping at the inner periphery increases and the overall quality of the chips improves. When using the current values of the angle α (12°–20°), the amount of coarse fractions produced at the outer periphery is reasonable due to higher chipping speed. The method produces chips of uniform quality irrespective of what portion of the knife is used for the chipping. Consequently, the effect of the capacity, of the different diameters or dry solids content of the logs is less on the quality of the chips.

In theory, functioning according to the invention can be achieved just by changing the distance D between the surface 10 and the knife edge 16. Because the construction of a chipper imposes certain limits on the change of the distance D and because the effect of this change is not so significant as the change of the angle α, the change of the distance D can be applied only to a short portion of the knife base or knife backing.

In practice, when using a long knife, the knife base or knife backing can be designed, as is shown in FIG. 7, so that the value of the angle α is 0° in the first quarter of the knife length, 0.25 L, (L=the length of the knife) from that end 14 of the knife base that is situated on the side of the shaft, and so that the angle obtains the value of +20° along the following half of the knife length (0.5 L). If the problem is the share of coarse fractions, the knife backing can be so designed that it approaches the knife edge 16 at the inner edge. In FIG. 7, the dashed line K stands for this. In FIG. 8, the same is shown in the knife base 9 so that the distance D is shorter than the one at the outer edge.

It is clear, that the knife base or knife backing according to the invention are constructed by using the above-mentioned combinations in such a way that the best possible quality of chips is obtained.

What is claimed is:

1. A method of chipping wood comprising:

providing a disc chipper having a plurality of knives;

forming wood chips with the disc chipper by separating chips from a log;

passing the wood chips through a chip opening in the disc such that the wood chips hit an impact surface located after one of the plurality of knives, wherein the direction of the impact surface deviates from the direction of a rear surface of said one of the plurality of knives so that the wood chips split into smaller pieces and separate from each other, and creating a stronger impact effect in proximity to the center of the disc than in than in proximity to the outer periphery of the disc in order to produce chips of uniform quality along all portions of said one of the plurality of knives, wherein the stronger impact effect is created by at least one of (i) making the chips hit the impact surface, wherein the direction of the impact surface in proximity to the center of the disc deviates more from the direction of the rear surface of the knife than in proximity to the outer periphery of the disc, and (ii) making the chips, before they hit the impact surface, pass further behind the rear surface of the knife in proximity to the outer periphery of the disc than in proximity to the center of the disc.

2. A disc chipper comprising, a rotatable disc, a plurality of knives fastened to the rotatable disc, a fixed counter knife disposed on the rotatable disc, and an elongated chip opening disposed in the disc adjacent to each of said plurality of knives, wherein a wall surface of each opening joins a rear surface of each said knife and a direction of the wall surface deviates from the direction of the rear surface of the knife to thereby define an impact surface located after the knife, wherein the direction of the impact surface deviates more from the direction of the rear surface of the knife in proximity to the center of the disc than in proximity to the outer periphery of the disc.

3. A disc chipper as defined in claim 2, wherein the angle between the impact surface and the rear surface of the knife changes about 20 degrees from the center of the disc to the outer periphery of the disc.

4. A disc chipper as defined in claim 2, wherein the distance of a connecting line between the rear surface of each said knife and the respective impact surface from a cutting edge of the knife is greater in proximity to the outer periphery of the disc than in proximity to the center of the disc.

5. A disc chipper comprising, a rotatable disc, a plurality of knives fastened to the rotatable disc, a fixed counter knife disposed on the rotatable disc, and an elongated chip opening disposed in the disc adjacent to each of said plurality of knives, wherein a wall surface of each of the openings joins a rear surface of each of the plurality of knives and a direction of the wall surface deviates from the direction of the rear surface of each said knife to thereby define an impact surface located after each said knife, wherein the distance of a connecting line between the rear surface of each said knife and the respective impact surface from a cutting edge of the knife is greater in proximity to the outer periphery of the disc than in proximity to the center of the disc.

6. A disc chipper as defined in claim 5, wherein the angle between the impact surface and the rear surface of the knife changes about 20 degrees from the center of the disc to the outer periphery of the disc.

* * * * *